US006148649A

United States Patent [19]

Shin

[11] Patent Number: 6,148,649

[45] Date of Patent: Nov. 21, 2000

[54] WASHING MACHINE WITH A DEVICE FOR ELIMINATING HYDROPHOBIC SUBSTANCES CONTAINED IN WASHING WATER

[75] Inventor: Jung-soo Shin, Suwon, Rep. of Korea

[73] Assignee: Samsung Electronics Co., Ltd., Suwon, Rep. of Korea

[21] Appl. No.: 09/159,473

[22] Filed: Sep. 23, 1998

[30] Foreign Application Priority Data

Jun. 15, 1998 [KR] Rep. of Korea ..... 98-22352

[51] Int. Cl.[7] ..... D06F 3/00

[52] U.S. Cl. ..... 68/183; 68/207

[58] Field of Search ..... 68/207, 208, 183; 134/102.1, 102.2; 366/176.1, 340; 261/113, 100, 77, 123, 123.1; 210/703, 222.2

[56] References Cited

U.S. PATENT DOCUMENTS

| | | | |
|---|---|---|---|
| 1,036,988 | 8/1912 | Fink | 134/102.2 |
| 1,526,179 | 2/1925 | Parr et al. | 68/186 U X |
| 1,663,911 | 3/1928 | Heath | 68/183 |
| 2,135,043 | 11/1938 | Seman | 134/102.1 |
| 3,117,436 | 1/1964 | Fresard et al. | 68/183 |
| 3,418,832 | 12/1968 | Valdespino | 68/183 |
| 3,935,104 | 1/1976 | Russell et al. . | |
| 4,913,805 | 4/1990 | Chin | 210/703 |
| 5,156,745 | 10/1992 | Cairo, Jr. et al. | 210/703 |
| 5,242,580 | 9/1993 | Sury . | |
| 5,303,566 | 4/1994 | Wolney et al. | 68/208 |
| 5,693,263 | 12/1997 | Meekel et al. . | |
| 5,855,769 | 1/1999 | Firth et al. . | |
| 5,914,034 | 6/1999 | Ding et al. . | |

FOREIGN PATENT DOCUMENTS

| | | | |
|---|---|---|---|
| 970610 | 1/1951 | France | 68/207 |
| 239621 | 10/1986 | Germany | 68/183 |
| 59-8999 | 1/1984 | Japan | 68/183 |
| 59-55293 | 3/1984 | Japan | 68/183 |
| 3-162894 | 7/1991 | Japan | 68/183 |
| 6-126090 | 5/1994 | Japan . | |
| 6-226248 | 8/1994 | Japan . | |
| 11-019392 | 1/1999 | Japan . | |
| 52153 | 4/1932 | Norway | 68/183 |
| 672251 | 7/1979 | U.S.S.R. | 68/183 |
| 29618 | of 1904 | United Kingdom | 68/183 |
| 14086 | of 1915 | United Kingdom | 68/183 |
| 430684 | 6/1935 | United Kingdom | 68/183 |

*Primary Examiner*—Frankie L. Stinson
*Attorney, Agent, or Firm*—Burns, Doane, Swecker & Mathis, L.L.P.

[57] ABSTRACT

Disclosed is a washing machine having a device for eliminating hydrophobic substances contained in washing water, such as oil or hydrophobic groups of detergent. The device comprises a part for generating bubbles by spraying washing water, a part for separating the bubbles containing hydrophobic substances from the sprayed washing water, and a part for collecting the hydrophobic substances by drawing the separated bubbles. The washing water in which the hydrophobic substances have been eliminated is circulated into a tub. The circulated washing water contains detergent having only hydrophilic substances, so the washing operation is effectively performed, water contamination caused by the drained washing water is prevented, and laundry is effectively rinsed.

8 Claims, 4 Drawing Sheets

WASHING MACHINE WITH A DEVICE FOR ELIMINATING HYDROPHOBIC SUBSTANCES CONTAINED IN WASHING WATER

BACKGROUND OF THE INVENTION

1. Field of the Invention

The present invention relates to a washing machine, and more particularly, to a washing machine capable of separating and collecting hydrophobic substances contained in washing water.

2.Prior Art

A general washing machine for washing and dehydrating laundry has, as shown in FIG. 1, a casing 100 for forming an appearance thereof, an outer tub 110 supported by a plurality of suspensions 120 in the casing 100, a washing tub 130 installed in the outer tub 110 in order to accommodate laundry, a pulsator 140 installed at the bottom of the washing tub 130, a driving motor 150 installed under the outer tub 110, and a gear assembly 160 for transmitting the power of the driving motor 150 to the pulsator 140 and the washing tub 130 selectively.

Ducts 200 are formed in the inner wall of the washing tub 130. The ducts 200 form vertical water passages in the inner wall of the washing tub 130. A discharge opening is formed at the upper end of the duct 200, and an inflow opening is formed at the lower end of the duct 200. The washing water in the washing tub 130 flows into the duct 200 through the inflow opening and is discharged from the duct 200 through the discharge opening. A filter 103 for filtering dirt in the washing water is attached to the discharge opening.

A plurality of holes 131 are formed at the side wall of the washing tub 130. The outer tub 110 and the washing tub 130 communicate with each other through the holes 131. Therefore, the water supplied into the washing tub 130 is also supplied into the outer tub 110.

On the upper side of the outer tub 110, a supply pipe 171 for supplying water needed in washing operation into the outer tub 110 and washing tub 130, and a detergent supplier 170 for dissolving detergent with the supplied water are installed.

Under the outer tub 110 is installed a draining device 180 for draining the water in the outer tub 110 during the draining operation and dehydrating operation of the washing machine.

The operation of such a conventional washing machine is as follows.

When a user puts laundry in the washing tub 130 and operates the washing machine, the washing tub 130 is supplied with water through the supply pipe 171. The detergent in the detergent supplier 170 is dissolved by the supplied water, and then the water containing detergent is supplied into the washing tub 130.

During the washing operation, the power of the driving motor 150 is transmitted to the pulsator 140 through the gear assembly 160. Then, the pulsator 140 is rotated so as to generate vortex water flow in the washing tub 130. The laundry accommodated in the washing tub 130 is washed by the vortex water flow generated by the pulsator 140.

When the pulsator 140 rotates, the washing water flows into the ducts 200 by centrifugal force. The washing water flowing into the duct 200 is moved upward, and is discharged through the discharge opening. The dirt contained in the washing water is filtered by the filter 103, and the filtered washing water is re-supplied to the washing tub 130.

As described, laundry is washed by the vortex water flow generated by the pulsator 140 and by the circulating water flow generated by the ducts 200.

During the dehydrating operation, the power of the driving motor 150 is transmitted to the washing tub 130 and the pulsator 140 simultaneously through the gear assembly 160, whereby the washing tub 130 and the pulsator 140 are rotated together at a high rotational speed. Dehydration is performed by the centrifugal force generated in such a situation. During the dehydrating operation, the water in the washing tub 130 is drained outside through the holes 131 and the draining device 180. After the dehydrating operation, a rinsing operation is performed.

However, such a conventional washing machine has the following problems.

The detergent used in washing operation has hydrophilic groups which are polar atomic radicals having great affinity for water, and hydrophobic groups which are nonpolar atomic radicals having little affinity for water and great affinity for oil. The hydrophobic groups contained in the detergent are not dissolved in the washing water completely, so the undissolved detergent is drained together with the washing water during the draining operation, which may cause contamination of water. Furthermore, oil detached from the laundry by the detergent is drained together with the washing water, which also causes the water contamination.

Moreover, in order to get rid of the undissolved detergent in the washing water, the laundry must be rinsed many times, so a great amount of water and time is consumed during the operation of a washing machine.

SUMMARY OF THE INVENTION

The present invention has been proposed to overcome the above described problems in the prior art, and accordingly it is an object of the present invention to provide a washing machine capable of separating and collecting hydrophobic groups in detergent and oil which are not dissolved in washing water during the washing operation thereof, whereby water contamination is prevented and the rinsing operation is effectively performed.

To achieve the above object, the present invention provides a washing machine comprising: a tub for accommodating laundry and washing water; a bubble generation part for generating bubbles by spraying the washing water in the tub; a bubble separation part for separating the bubbles containing hydrophobic substances from the sprayed washing water; and a collection part for collecting the hydrophobic substances by drawing the bubbles separated by the bubble separation part.

Here, the bubble generation part comprises: a first pump for drawing and spouting the washing water; a nozzle being installed at the first pump, the nozzle for spraying the washing water; and a venturi tube for generating bubbles in the washing water sprayed by the nozzle.

Further, the bubble separation part comprises a second pump for drawing the sprayed washing water, and a circulation pipe for circulating the washing water pumped by the second pump into the tub.

Furthermore, the collection part comprises a fan for drawing the bubbles containing the hydrophobic substances. The fan is disposed over the bubble generation part, whereby the bubbles can be easily drawn toward the fan.

Preferably, the collection part further comprises a container for receiving the hydrophobic substances in the bubbles drawn by the fan. Furthermore, a means for attaching the container to be capable of detaching is provided on one side of a casing of the washing machine. Thus, the user can attach and detach the container.

According to the present invention, the circulated washing water contains the detergent having only the hydrophilic groups. Therefore, the washing operation is effectively performed, and water contamination caused by the washing water drained by the draining device is prevented. Furthermore, the rinsing operation is effectively performed, whereby laundry is sufficiently rinsed by a fewer number of rinsing operations.

BRIEF DESCRIPTION OF THE DRAWINGS

The present invention will be better understood and its various objects and advantages will be more fully appreciated from the following description taken in conjunction with the accompanying drawings, in which:

FIGS. 4 and 5 are views for showing the process that the hydrophobic substances are caught in a bubble, in which FIG. 4 shows the bubble before catching, and FIG. 5 shows the bubble after catching the hydrophobic substances.

DETAILED DESCRIPTION OF THE PREFERRED EMBODIMENT

Figure 1:
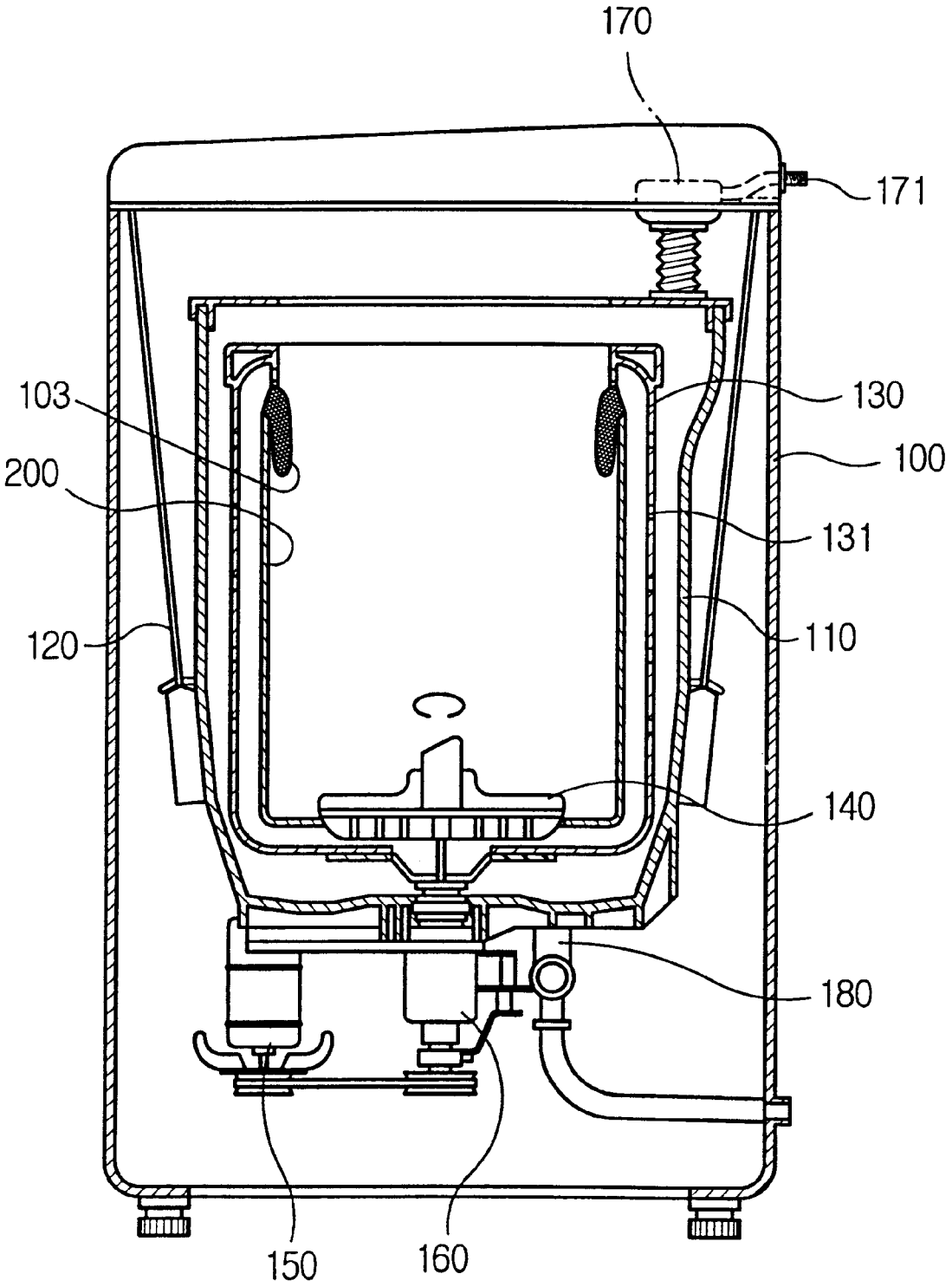
FIG. 1 (PRIOR ART)
FIG. 1 is a side sectional view of a conventional washing machine.

Hereinafter, the present invention will be described in detail with reference to the drawings. Parts identical to those in the conventional washing machine will not be described, and will be referred to with the same reference numerals.

Figure 2:
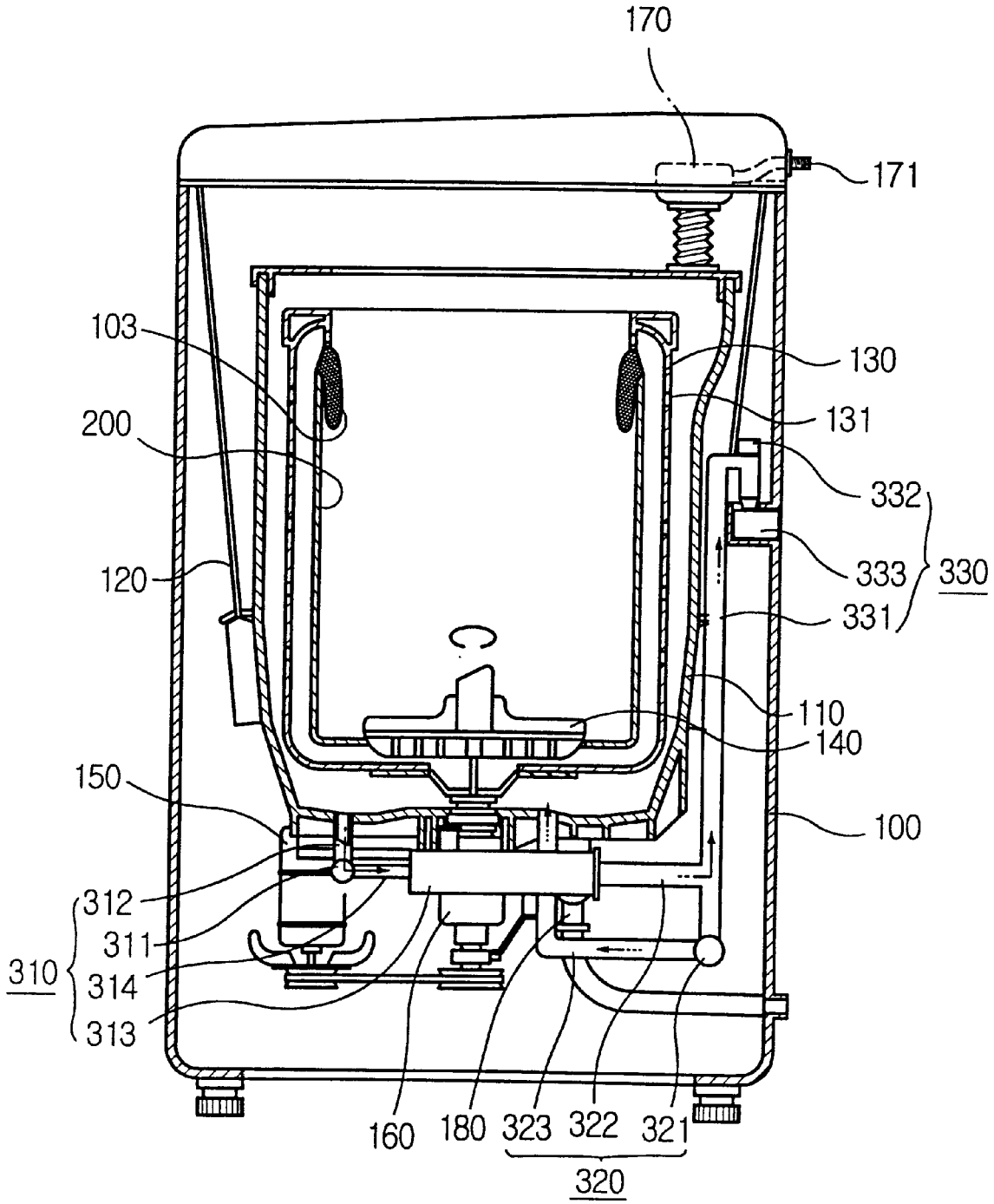
FIG. 2 is a side sectional view of a washing machine according to the present invention.
Figure 3:
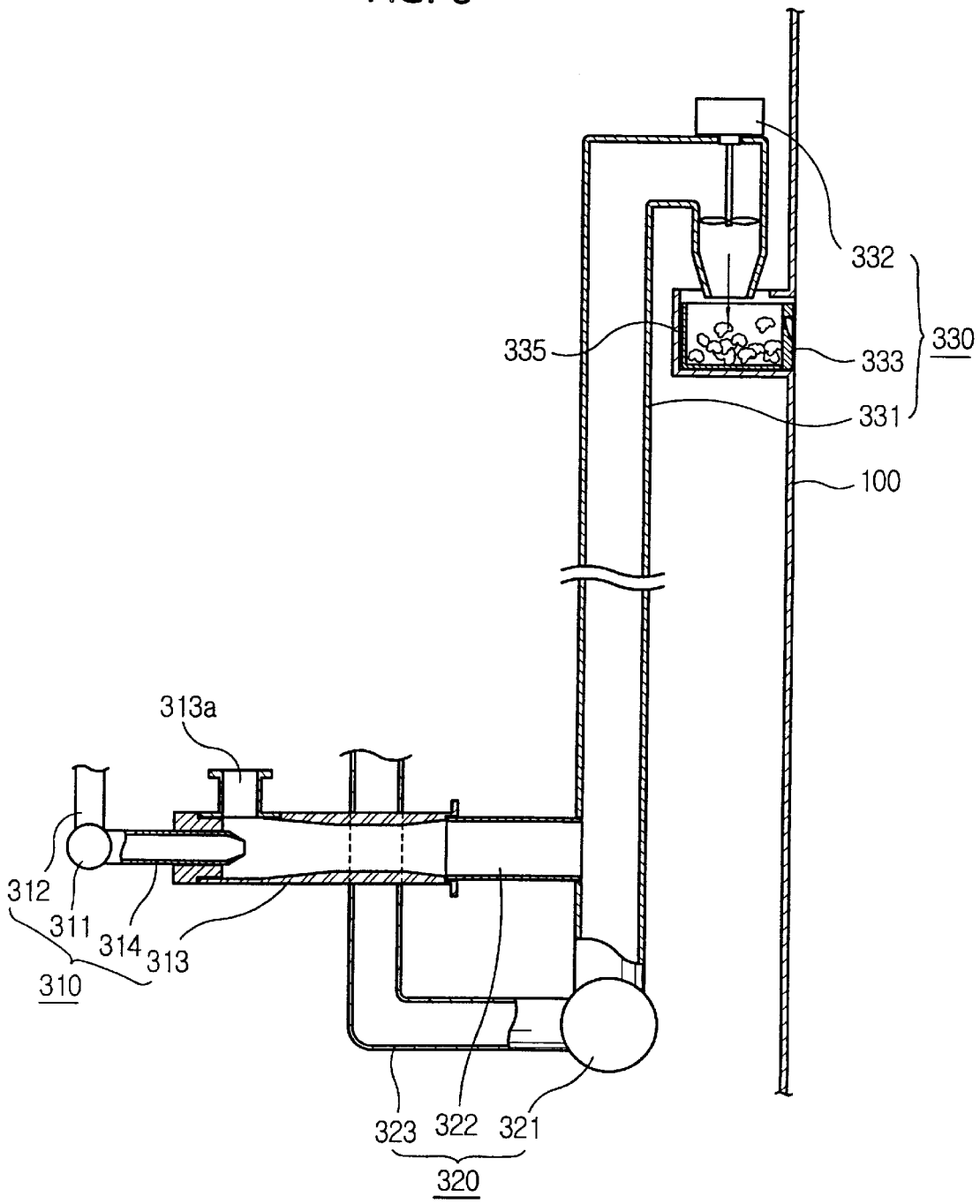
FIG. 3 is an partial enlarged view of FIG. 2, which shows the device for eliminating hydrophobic substances according to the present invention.

FIG. 2 is a side sectional view of a washing machine according to the present invention, and FIG. 3 is a view showing the device for eliminating hydrophobic substances according to the present invention.

The washing machine according to the present invention has, like the conventional washing machine shown in FIG. 1, an outer tub 110, a washing tub 130, a driving motor 150, a gear assembly 160, a supply pipe 171, and a draining device 180.

The washing machine according to the present invention is equipped with a device for eliminating hydrophobic substances contained in washing water. The device comprises a bubble generation part 310 for generating bubbles by spraying washing water in the outer tub 110, a bubble separation part 320 for separating the bubbles containing hydrophobic substances from the sprayed washing water, and a collection part 330 for collecting the hydrophobic substances by drawing the bubbles separated by the bubble separation part 320.

The bubble generation part 310 comprises a first pump 311 installed under the outer tub 110, a first pipe 312 for connecting the outer tub 110 with the first pump 311, a nozzle 314 installed at the first pump 311, and a venturi tube 313 installed at the end of the nozzle 314. The venturi tube 313 has an inflow pipe 313*a* at the upper side thereof, through which outside air flows thereinto.

The bubble separation part 320 comprises a second pump 321 installed under the outer tub 110, a second pipe 322 for connecting the venturi tube 313 with the second pump 321, and a circulation pipe 323 for connecting the second pump 321 with the outer tub 110.

The collection part 330 comprises a third pipe 331 connected with the second pipe 322, a fan 332 installed in the third pipe 331, and a container 333 installed at the end area of the third pipe 331. The third pipe 331 is extended upward from the second pipe 322, and the fan 332 is disposed at a higher position than the bubble separation part 320.

On the outer side of the casing 100 is provided a chamber 335 for accommodating the container 333. The chamber 335 is formed by recessing the casing 100 inward. A user can install the container 333 into the washing machine by inserting the container 333 into the chamber 335 from the outside of the washing machine. Therefore, the container 333 can be easily attached and detached. The upper side of the chamber 335 is open so that the substances discharged from the third pipe 331 are collected in the container 333.

Hereinbelow, the operation of the washing machine having the above construction will be described with reference to FIGS. 2 through 5.

Figure 4:
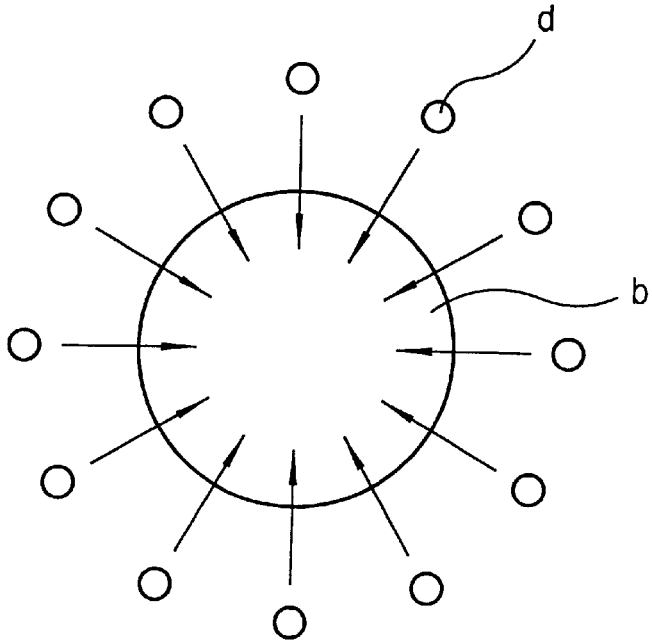
Figure 5:
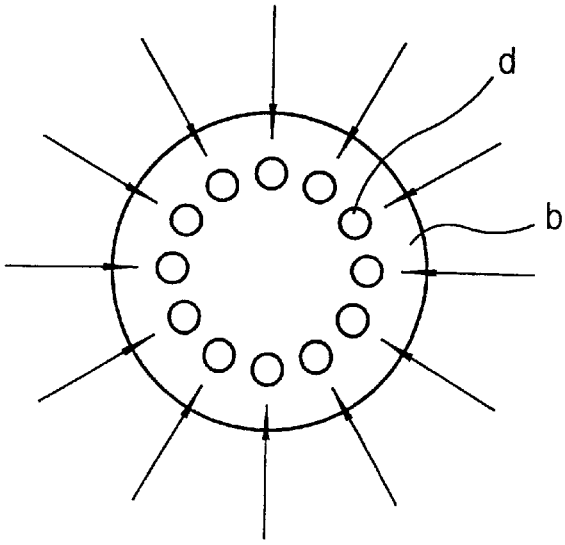

The laundry and the washing water in which the detergent is dissolved are accommodated in the washing tub 130 and the outer tub 110. The first pump 311 draws the washing water from the outer tub 110 through the first pipe 312. The drawn washing water is spouted into the nozzle 314 by the first pump 311, and then is sprayed into the venturi tube 313 by the nozzle 314. In such a situation, outside air is drawn into the venturi tube 313 through the inflow pipe 313*a* by the pressure of the sprayed washing water. The drawn air and the sprayed washing water are mixed with each other, whereby bubbles b as shown in FIG. 4 are generated in the washing water.

In such a situation, since hydrophobic substances d contained in the washing water, such as oil or hydrophobic groups in the detergent, have the property they will not dissolved in water, they are separated from the washing water and caught by the bubbles b. Therefore, in the venturi tube 313, the washing water is divided into washing water containing hydrophilic groups of the detergent and bubbles b containing the hydrophobic substances d.

The washing water flows out from the venturi tube 313 through the second pipe 322, and the second pump 321 draws the washing water to circulate it into the outer tub 110 through the circulation pipe 323. In such a situation, the bubbles b containing the hydrophobic substances d float from the washing water and are collected in the third pipe 331. The bubbles b in the third pipe 331 are drawn by the fan 332 so as to moved upward through the third pipe 331. Since the fan 332 is disposed over the bubble separation part 320, the operation for drawing the bubbles b without the washing water is easily performed.

The bubbles b drawn by the fan 332 are discharged into the container 333, whereby the hydrophobic substances d contained in the bubbles b are collected in the container 333.

Such an operation for collecting hydrophobic substances contained in the washing water into the container 333 is continuously performed during the washing operation, and after the washing operation is completed, the rinsing and dehydrating operations are preformed just as in the conventional washing machine.

In the present embodiment, the operation for eliminating the hydrophobic substances is performed during the washing operation, however, such an operation can be performed during the rinsing operation as well.

According to the present invention, the washing water in the washing tub 130 contains the detergent having only the hydrophilic groups. Therefore, the washing operation is effectively performed, and water contamination caused by the washing water drained by the draining device 180 is prevented. Furthermore, since the detergent contains only the hydrophilic groups, the rinsing operation is effectively performed, whereby the laundry is sufficiently rinsed by a fewer number of rinsing operations. Therefore, water consumption and the total operation time of the washing machine are reduced.

Although the present invention has been described and illustrated in detail, it is clearly understood that the same is by way of illustration and example only and is not to be taken by way of limitation, wherein the spirit and scope of the present invention is limited only by the terms of the appended claims.

What is claimed is:

1. A washing machine comprising:

a tub for accommodating washing water;

a bubble generation part for generating bubbles by spraying the washing water in said tub;

a bubble separation part for separating the bubbles from the sprayed washing water and simultaneously circulating the bubble-removed washing water back into said tub; and a collection part for collecting the bubbles by sucking in the bubbles separated by said bubble separation part.

2. The washing machine as claimed in claim 1, wherein said bubble generation part comprises:

a first pump for pumping the washing water in said tub;

a nozzle disposed downstream said first pump, said nozzle arranged for spraying the washing water pumped by said first pump; and a venturi tube for generating bubbles from the washing water sprayed by said nozzle.

3. The washing machine as claimed in claim 2, wherein said bubble separation part includes a second pump for circulating the bubble-removed washing water back into said tub.

4. The washing machine as claimed in claim 1, wherein said collection part includes a fan for sucking in the bubbles.

5. The washing machine as claimed in claim 4, wherein said fan is disposed above said bubble generation part.

6. The washing machine as claimed in claim 5, wherein said collection part further includes a container for receiving the bubbles sucked by said fan.

7. The washing machine as claimed in claim 7, wherein said container is replaceably accommodated in a recess in an inner side of a casing.

8. A washing machine comprising:

a tub for accommodating laundry and washing water;

a bubble generation part for generating bubbles by spraying the washing water in said tub;

a bubble separation part for separating the bubbles containing hydrophobic substances from the sprayed washing water; and a collection part for collecting the hydrophobic substances by drawing the bubbles separated by said bubble separation part;

wherein said bubble separation part comprises a pump for drawing the sprayed washing water, and a circulation pipe for circulating the washing water pumped by said pump, back into said tub.

* * * * *